US006586148B1

(12) United States Patent
Graham et al.

(10) Patent No.: US 6,586,148 B1
(45) **Date of Patent: *Jul. 1, 2003**

(54) IMAGING MEMBERS

(75) Inventors: John F. Graham, Oakville (CA); Timothy P. Bender, Port Credit (CA); Liang-Bih Lin, Webster, NY (US); Andronique Ioannidis, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/059,405

(22) Filed: Jan. 31, 2002

(51) Int. Cl.[7] ..... G03G 5/06
(52) U.S. Cl. ..... 430/58.65; 430/58.8; 430/59.5
(58) Field of Search ..... 430/53, 83, 78, 430/59.4, 59.5, 58.8, 58.65

(56) References Cited

U.S. PATENT DOCUMENTS

| | | | | |
|---|---|---|---|---|
| 4,265,990 A | | 5/1981 | Stolka et al. | 430/59 |
| 4,474,865 A | | 10/1984 | Ong et al. | 430/58 |
| 4,587,189 A | | 5/1986 | Hor et al. | 430/59 |
| 5,336,577 A | | 8/1994 | Spiewak et al. | 430/59 |
| 5,473,064 A | * | 12/1995 | Mayo et al. | 540/141 |
| 5,495,049 A | | 2/1996 | Nukada et al. | 564/433 |
| 5,587,263 A | | 12/1996 | Nukada et al. | 430/56 |
| 5,851,712 A | * | 12/1998 | Muto et al. | 430/78 |

FOREIGN PATENT DOCUMENTS

| | | | |
|---|---|---|---|
| JP | 2000-019758 | * | 1/2000 |

OTHER PUBLICATIONS

Copending application U.S. Ser. No. 09/302,524, filed Apr. 30, 1999, titled "Photoconductive Members".
Copending application U.S. Ser. No. 09/627,283, filed Jul. 28, 2000, titled "Imaging Members Having A Single Electrophotographic Photoconductive Insulating Layer".

* cited by examiner

*Primary Examiner*—John Goodrow
(74) *Attorney, Agent, or Firm*—E. D. Palazoo

(57) ABSTRACT

A photoconductive member with a supporting substrate, and thereover a first layer comprised of a mixture of a photogenerator component, a hole transport component, and an electron transport component; and thereover a second layer comprised of a charge transport component.

33 Claims, No Drawings

IMAGING MEMBERS

RELATED PATENT APPLICATIONS

Illustrated in application U.S. application Ser. No. 09/302,524, filed Apr. 30, 1999, titled "Photoconductive Members", the disclosure of which is totally incorporated herein by reference, is for example, an ambipolar photoconductive imaging member comprised of a supporting substrate, and thereover a layer comprised of a photogenerator hydroxygallium component, a charge transport component, and an electron transport component.

Illustrated in now abandoned application U.S. application Ser. No. 09/627,283, filed Jul. 28, 2000, titled "Imaging Members Having A Single Electrophotographic Photoconductive Insulating Layer", the disclosure of which is totally incorporated herein by reference, is for example, a member comprising a supporting layer and a single electrophotographic photoconductive insulating layer, the electrophotographic photoconductive insulating layer comprising particles comprising Type V hydroxygallium phthalocyanine dispersed in a matrix comprising an arylamine hole transporter and an electron transporter selected from the group consisting of N,N'-bis(1,2-dimethylpropyl)-1,4,5,8-naphthalenetetracarboxylic diimide represented by the following formula.

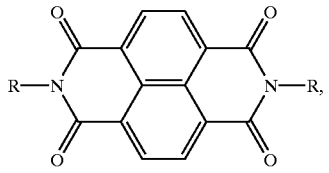

1,1 '-dioxo-2-(4-methylphenyl)-6-phenyl-4-(dicyanomethylidene) thiopyran represented by the following structural formula

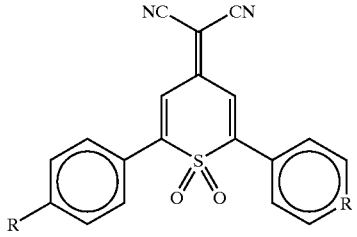

wherein $R_1$ and $R_2$ are independently selected from the group consisting of hydrogen, alkyl having 1 to 4 carbon atoms, alkoxy having 1 to 4 carbon atoms and halogen, and a quinone selected from the group consisting of carboxybenzylnaphthaquinone represented by the following structural formula

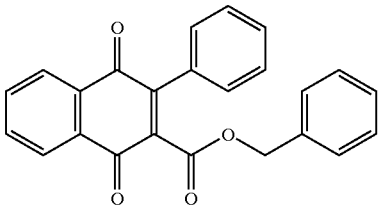

and tetra(t-butyl) diphenoquinone represented by the following structural formula

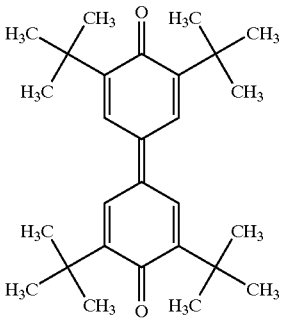

and mixtures thereof, and a film forming binder.

The appropriate components and processes of the above copending applications may be selected for the invention of the present application in embodiments thereof.

BACKGROUND

This invention relates in general to imaging members and, more specifically, to negatively charged electrophotographic imaging members having an electrophotographic photoconductive insulating bilayer and processes for forming images on the member. More specifically, the present invention relates to a bilayered photoconductive imaging member containing a charge generation layer or photogenerating layer comprised of a photogenerating component, such as a photogenerating pigment, dispersed in a resin binder containing hole transporting and electron transporting molecule (s), and thereover as the second or top layer a charge transporting layer, especially a hole transport layer. The photogenerating layer, which can be dispersed in various suitable resin binders, can be of various thicknesses, however, in embodiments a thick photogenerating layer, such as from about 3 to about 50 microns, and more specifically, from about 5 to about 20 microns is selected. This first layer can be considered a dual functioning layer since it can generate charge and transport charge over a wide distance, such as a distance of at least about 20 microns. Also, the presence of the electron transport components in the photogenerating layer can enhance electron mobility and thus enable a thicker photogenerating layer, and which thick layers can be more easily coated than a thin layer, such as about 1 to about 2 microns thick.

Many imaging members are multilayered imaging members comprising a substrate and a plurality of other layers such as a charge generating layer and a charge transport layer. These multilayered imaging members often also contain a charge blocking layer and an adhesive layer between the substrate and the charge generating layer, and an anti-plywooding layer may be selected. "Plywooding" refers, for example, in embodiments to the formation of unwanted patterns in electrostatic latent images caused by multiple reflections during laser exposure of a charged imaging member. When developed, these patterns resemble plywood. Multilayered imaging members are costly and time consuming to fabricate primarily because of the many layers that need to be formed. Further, complex equipment and valuable factory floor space are needed to manufacture multilayered imaging members. In addition to presenting plywooding problems, the multilayered imaging members often encounter charge spreading which degrades image resolution.

Another problem encountered with multilayered photoreceptors comprising a charge generating layer and a charge transport layer is that the thickness of the charge transport layer, which is normally the outermost layer, tends to become thinner due to wear during image cycling. This change in thickness causes changes in the electrical properties of the photoreceptor. Thus, to maintain image quality, complex and sophisticated electronic equipment is needed in the imaging machine to compensate for electrical changes, thereby increasing the complexity, cost, and size of the footprint occupied by the machine. Without proper compensation of the changing electrical properties of the photoreceptor during cycling, the quality of the images formed degrades due to spreading of the charge pattern on the surface of the imaging member causing a decline in image resolution. High quality images are important for digital copiers, duplicators, printers, and facsimile machines, particularly laser exposure machines that demand high resolution images. Moreover, the use of lasers to expose conventional multilayered photoreceptors can lead to the formation of undesirable plywood patterns that are visible in the final images.

Attempts have been made to fabricate suitable high resolution electrophotographic imaging members comprised of substrate and a single electrophotographic photoconductive insulating layer in place of a plurality of layers such as a charge generating layer and a charge transport layer. However, in formulating single electrophotographic photoconductive insulating layer photoreceptors, a number of problems need to be overcome including charge acceptance for hole and/or electron transporters. In addition to electrical compatibility and performance, a material mix for forming a single layer photoreceptor should possess the proper rheology and resistance to agglomeration to enable acceptable coatings. Also, compatibility among pigment, hole and electron transport molecules, and film forming binder is important.

Single electrophotographic photoconductive insulating layer refers in embodiments to, for example, a single electrophotographically active photogenerating layer capable of retaining an electrostatic charge in the dark during electrostatic charging, imagewise exposure and image development. Thus, unlike a single electrophotographic photoconductive insulating layer photoreceptor, a multilayered photoreceptor has at least two electrophotographically active layers, namely at least one charge generating layer and at least one separate charge transport layer.

REFERENCES

U.S. Pat. No. 4,265,990 a photosensitive member having at least two electrically operative layers is disclosed. The first layer comprises a photoconductive layer which is capable of photogenerating holes and injecting photogenerated holes into a contiguous charge transport layer. The charge transport second layer comprises a polycarbonate resin containing from about 25 to about 75 percent by weight of one or more of a compound having a specified general formula.

U.S. Pat. No. 5,336,577 discloses a thick organic ambipolar layer on a photoresponsive device which is simultaneously capable of charge generation and charge transport. In particular, the organic photoresponsive layer contains an electron transport material, such as a fluorenylidene malonitrile derivative, and a hole transport material, such as a dihydroxy tetraphenyl benzadine containing polymer. These may be complexed to provide photoresponsivity, and/or a photoresponsive pigment or dye may also be included.

The entire disclosures of these patents are incorporated herein by reference.

With respect to the prior art, only a small part thereof has been selected and this part may or may not be fully representative of the prior art teachings or disclosures.

SUMMARY

It is, therefore, a feature of the present invention to provide electrophotographic imaging members comprising an electrophotographic photoconductive member layer having two layers of a thick charge generating layer overcoated with a charge transporting layer.

It is another feature of the present invention to provide an improved electrophotographic imaging member with two layers that avoids plywooding problems wherein the bottom or first layer contains a photogenerating pigment, an electron transport component and a hole transport component.

It is still another feature of the present invention to provide an improved electrophotographic imaging member comprising an electrophotographic photoconductive insulating member with two layers that eliminate the need for a charge blocking layer between a supporting substrate and the electrophotographic photoconductive insulating layer.

It is still another feature of the present invention to provide a photogenerating mixture layer of a thickness of, for example, from about 5 to about 20 microns overcoated with charge transporting molecules dispersed in a resin binder.

It is still another feature of the present invention to provide an electrophotographic single layer imaging member having two layers which can be fabricated with fewer coating steps at reduced cost compared to a multilayer imaging member.

It is yet another feature of the present invention to provide an improved electrophotographic imaging member with two layers, and which member possesses cycling and stability.

It yet another feature of the present invention there is provided an improved electrophotographic imaging member with two layers and wherein the PIDC curves do not substantially change with time or repeated use.

Aspects of the present invention relate to a photoconductive member comprised of a supporting substrate, and thereover a first layer comprised of a mixture of a photogenerator component, a hole transport component, and an electron transport component; and thereover a second layer comprised of a charge transport component; an imaging member wherein the first layer is of a thickness of from about 3 to about 50 microns; an imaging member wherein the amounts for each of the components in the first layer are from about 0.05 weight percent to about 30 weight percent for the photogenerating component, from about 10 weight percent to about 75 weight percent for the charge transport component, and from about 10 weight percent to about 75 weight percent for the electron transport component, and wherein the total of these components is about 100 percent, and wherein the layer is optionally dispersed in from about 10 weight percent to about 75 weight percent of a polymer binder, and wherein the first layer is of an optional thickness of from about 5 to about 20 microns; an imaging member wherein the amounts for each of the components in the first layer mixture are from about 0.5 weight percent to about 5 weight percent for the photogenerating component; from about 30 weight percent to about 50 weight percent for the charge transport component; and from about 5 weight percent to about 30 weight percent for the electron transport component; and which components are contained in from about 30 weight percent to about 50 weight percent of a polymer binder; a member wherein the thickness of the first layer is from about 5 to about 20 microns; an imaging member wherein the first layer components are contained in a polymer binder, and wherein the hole transport in the first layer is comprised of hole transport molecules and electron transport molecules, and wherein the charge transport in the second layer is comprised of hole transport molecules; an imaging member wherein the binder is present in an amount of from about 40 to about 90 percent by weight, and wherein the total of components of the photogenerating component, the charge transport component, the binder, and the electron transport component is about 100 percent; an imaging member wherein the photogenerating component is a pigment of a hydroxygallium phthalocyanine that absorbs light of a wavelength of from about 350 to about 950 nanometers; an imaging member wherein the supporting substrate is comprised of a conductive substrate comprised of a metal; an imaging member wherein the conductive substrate is aluminum, aluminized polyethylene terephthalate or titanized polyethylene terephthalate; an imaging member wherein the binder is selected from the group consisting of polyesters, polyvinyl butyrals, polycarbonates, polystyrene-b-polyvinyl pyridine, polyarylates, polyphenylene oxides, polyphenylene sulfonamides, polyimides, polyetherimides, polyesters, polyvinyl butyrals, polystyrenes and copolymers thereof and polyvinyl formals; an imaging member wherein the charge transport in the second layer comprises aryl amine molecules; an imaging member wherein the first layer hole transporting component or components, and/or the second layer is comprised of molecules of the formula

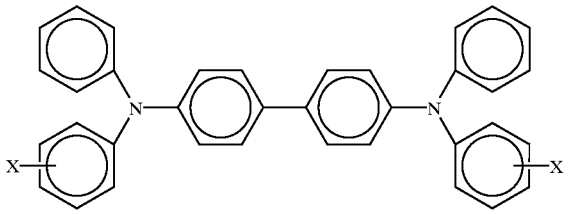

wherein X is selected from the group consisting of an alkyl, a halogen, an aryl or mixtures thereof; an imaging member wherein alkyl contains from about 1 to about 30 carbon atoms and wherein the charge transport is an aryl amine encompassed by the above formula and which amine is optionally dispersed in a highly insulating and transparent resinous binder; an imaging member wherein alkyl contains from 1 to about 5 carbon atoms; an imaging member wherein alkyl is methyl, and wherein halogen is chloride; an imaging member wherein the charge component is comprised of N,N'-diphenyl-N,N-bis(3-methyl phenyl)-1,1'-biphenyl4,4'-diamine; an imaging member wherein the electron transport component is (4-n-butoxycarbonyl-9-fluorenylidene) malononitrile, 2-methylthioethyl 9-dicyanomethylenefluorene-4-carboxylate, 2-(3-thienyl) ethyl 9-dicyanomethylenefluorene-4-carboxylate, 2-phenylthioethyl 9-dicyanomethylenefluorene-4-carboxylate, 11,11,12,12-tetracyano anthraquinodimethane N,N'-(bis alkyl or aryl)-1,4,5,8-naphthalene diimide or 1 ,3-dimethyl-10-(dicyanomethylene)-anthrone; an imaging member wherein the electron transport component is (4-n-butoxycarbonyl-9-fluorenylidene)malononitrile; an imaging member wherein the electron transport component is (4-n-butoxycarbonyl-9-fluorenylidene)malononitrile, 2-methylthioethyl 9-dicyanomethylenefluorene-4-carboxylate, 2-(3-thienyl)ethyl 9-dicyanomethylenefluorene-4-carboxylate, 2-phenylthioethyl 9-dicyanomethylenefluorene-4-carboxylate, 11,11,12,12-tetracyano anthraquinodimethane or 1,3-dimethyl-10-(dicyanomethylene)-anthrone; an imaging member wherein the photogenerating component is titanyl phthalocyanine, a metal phthalocyanine other than titanyl phthalocyanine, a metal free phthalocyanine, a perylene, a dimeric perylene, trigonal selenium, or mixtures thereof; an imaging member wherein for the first layer the photogenerating component is Type V hydroxygallium phthalocyanine, the electron transport is (4-n-butoxy carbonyl-9-fluorenylidene) malononitrile, and the hole transport is N,N'-diphenyl-N,N-bis(3-methyl phenyl)-1,1'-biphenyl-4,4'-diamine; an imaging member wherein for the first layer the photogenerating component is Type V hydroxygallium phthalocyanine, the electron transport is N,N'-(bis alkyl or aryl)-1,4,5,8-naphthalene diimide, and the hole transport is comprised of N,N'-diphenyl-N,N-bis(3-methyl phenyl)-1,1'-biphenyl4,4'-diamine; an imaging member wherein the Type V hydroxygallium phthalocyanine has major peaks, as measured with an X-ray diffractometer, at Bragg angles (2 theta+/−0.2°) of 7.4, 9.8, 12.4, 16.2, 17.6, 18.4, 21.9, 23.9, 25.0, 28.1 degrees, and the highest peak at 7.4 degrees; a member comprised of a mixture containing a photogenerating component, a charge transport component, and an electron transport component, and in contact with the first layer a second layer comprised of a charge transport component optionally dispersed in a resin binder; a member wherein the electron transport is (4-n-butoxycarbonyl-9-fluorenylidene) malononitrile, 2-methylthioethyl 9-dicyanomethylenefluorene-4-carboxylate, 2-(3-thienyl)ethyl 9-dicyanomethylenefluorene-4-carboxylate, 2-phenylthioethyl 9-dicyanomethylenefluorene-4-carboxylate, 11,11,12,12-tetracyano anthraquinodimethane or 1,3-dimethyl-10-(dicyanomethylene)-anthrone, the charge transport is a hole transport, the photogenerating component is an organic or inorganic photogenerating pigment, and the binder is present; an imaging member further containing an adhesive layer and a hole blocking layer; an imaging member wherein the blocking layer is contained as a coating on the supporting substrate, and wherein the adhesive layer is coated on the blocking layer; an imaging member wherein the member comprises in the following sequence the supporting layer, a first electrophotographic photoconductive insulating layer, the layer comprising particles comprising a photogenerating pigment dispersed in a matrix comprising an arylamine hole transport and an electron transport; an imaging member wherein the electron transport is N,N'-bis(alkyl or aryl)-1,4,5,8-naphthalene tetracarboxylic diimide represented by the formula

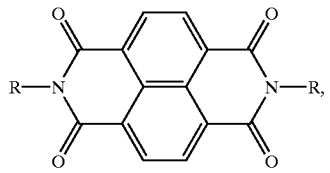

1,1'-dioxo-2-(4-methylphenyl)-6-phenyl-4-(dicyanomethylidene) thiopyran represented by the following formula

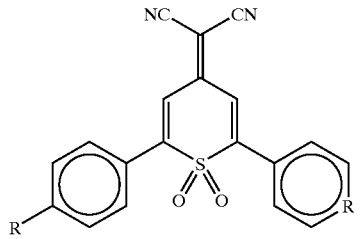

wherein each R is independently selected from the group consisting of hydrogen, alkyl optionally with 1 to 4 carbon atoms, alkoxy optionally with 1 to 4 carbon atoms and halogen, and a quinone selected from the group consisting of carboxybenzylnaphthaquinone represented by the following formula

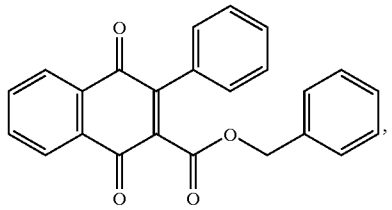

and tetra (t-butyl) diphenoquinone represented by the following formula

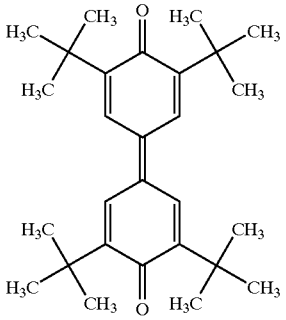

and mixtures thereof, and a film forming binder and a second layer over the first layer, and wherein the second layer is comprised of hole transport components; a member wherein the hole transport is comprised of an arylamine of N,N'-diphenyl-N, N'-bis(3-methylphenyl)-[1,1'-biphenyl]-4,4'-diamine, the film forming binder is a polycarbonate, the first electrophotographic photoconductive insulating layer has a thickness of about 3 micrometers to about 50 micrometers after drying; or wherein the photogenerating photoconductive insulating layer has a thickness of about 5 micrometers to about 20 micrometers after drying, wherein the member is free of any charge blocking layer between the supporting layer and the photogenerating layer, wherein the member is free of any charge generating layer between the supporting layer and the photogenerating layer, or wherein the member is free of any antiplywood layer between the supporting layer and the photogenerating layer; a method of imaging which comprises generating an electrostatic latent image on the imaging member, developing the latent image, and transferring the developed image to a suitable substrate; a composition comprised of a mixture of a photogenerator component, a charge transport component, and an electron transport component; a photoconductive imaging member comprised of a supporting substrate, a thick layer, about 5 to about 20 microns, comprised of a mixture of a photogenerating pigment, a hole transport component and an electron transport component, and in contact with this layer and coated thereover a charge transport layer containing a hole transporting component dispersed in a resin binder; an imaging member with a thick, such as for example, from about 10 to about 25 microns, single active layer comprised of a mixture of photogenerating pigments, hole transport compounds and electron transport compounds; a photoconductive imaging member comprised in sequence of a substrate, an electrophotographic photoconductive insulating layer, a layer comprising photogenerating pigments, such as hydroxygallium phthalocyanine Type V, and/or x-form metal free phthalocyanine and/or titanylphthalocyanine, such as Type IV and/or chlorogallium phthalocyanine and/or a perylene or a dimeric perylene charge generating material and/or a bisazo charge generating material dispersed in a matrix comprising hole transport molecules such as, for example, molecules selected from the group consisting of an arylamine and a hydrazone and an electron transporter of, for example, selected from the group consisting of N,N'-bis(alkyl or aryl)-1,4,5,8-naphthalenetetracarboxylic diimide represented by the following formula

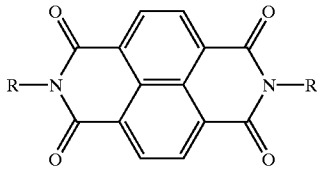

wherein R is selected from the group consisting of hydrogen, alkyl, branched alkyl, cycloalkyl, substituted alkyl, aryl or substituted alkyl with 1 to about 30 atoms for the aliphatic Rs and from about 6 to about 36 carbon atoms for aryl, 1,1'-Dioxo-2-(4-alkylphenyl)-6-phenyl-4-(dicyanomethylidene) thiopyran represented by the following formula

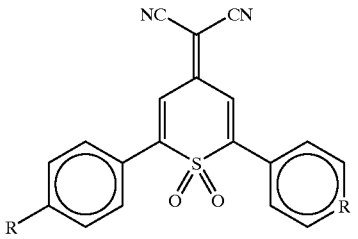

wherein $R_1$ and $R_2$ are independently selected from the group consisting of hydrogen, alkyl optionally with 1 to 4 carbon atoms, alkoxy optionally with 1 to 4 carbon atoms and halogen, and a quinone selected, for example, from the group consisting of carboxybenzylnaphthaquinone represented by the following formula

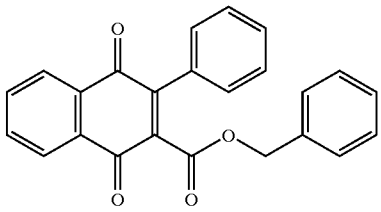

and tetra(t-butyl) diphenoquinone represented by the following formula

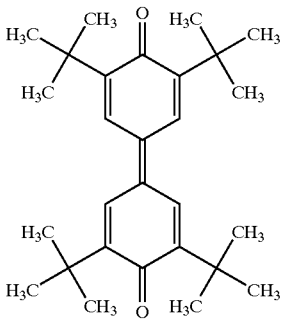

and mixtures thereof, and overcoated with a top layer comprised of a hole transport material in a resin binder; a photoconductive imaging member comprised of supporting substrate, and thereover a layer comprised of a mixture of a photogenerator pigment, such as a hydroxygallium phthalocyanine component, a charge transport component, and an electron transport component; a member wherein the mixture layer is of a thickness of from about 5 to about 50 microns; a member wherein the amounts for each of the components in the mixture are from about 0.05 weight percent to about 30 weight percent for the photogenerating component, from about 10 weight percent to about 70 weight percent for the charge transport component, and from about 10 weight percent to about 70 weight percent for the electron transport component, and wherein the total of the components is about 100 percent, and wherein the layer is dispersed in from about 10 weight percent to about 75 weight percent of a polymer binder; a member wherein the amounts for each of the components is from about 0.5 weight percent to about 5 weight percent for the photogenerating component; from about 30 weight percent to about 50 weight percent for the charge transport component; and from about 5 weight percent to about 30 weight percent for the electron transport component; and which components are contained in from about 30 weight percent to about 50 weight percent of a polymer binder; a member wherein the thickness of the photogenerating layer mixture is from about 10 to about 30 microns; a member wherein the first layer components are contained in a polymer binder, and wherein the charge transport is comprised of hole transport molecules and electron transport molecules; a member wherein the binder is present in an amount of from about 50 to about 90 percent by weight and wherein the total of all components of photogenerating component, the charge transport component, the binder, and the electron transport component is about 100 percent; a member wherein the photogenerating hydroxygallium absorbs light of a wavelength of from about 350 to about 950 nanometers; an imaging member wherein the supporting substrate is comprised of a conductive substrate comprised of a metal; an imaging member wherein the conductive substrate is aluminum, aluminized polyethylene terephthalate or titanized polyethylene terephthalate, and the like; an imaging member wherein the binder for the photogenerating mixture layer and for the top charge transport layer is selected from the group consisting of polycarbonates, polyarylates, polyphenylene oxides, polyphenylene sulfonamides, polyimides, polyetherimides, polyesters, polyvinyl butyrals, polystyrenes and copolymers thereof, polystyrene-b-polyvinyl pyridine, and polyvinyl formals; an imaging member wherein the charge transport in the photogenerating mixture and the charge transport top layer comprise aryl amine molecules; an imaging member wherein the charge transport in the photogenerating mixture and for the charge transport top layer is comprised of

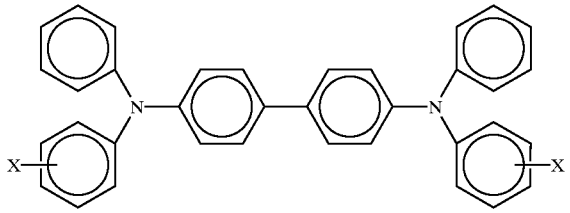

wherein X is selected from the group consisting of alkyl, aryl and halogen; an imaging member wherein alkyl or aryl contains from about 1 to about 30 carbon atoms and wherein the charge transport is an aryl amine encompassed by the above formula, and which amine is dispersed in a highly insulating and transparent resin binder; an imaging member wherein alkyl contains from 1 to about 6 carbon atoms; an imaging member wherein alkyl is methyl or ethyl, and wherein halogen is chloride or bromide; an imaging member wherein the charge transport is comprised of N,N'-diphenyl-N,N-bis(3-methyl phenyl)-1,1'-biphenyl-4,4'-diamine or the triarylamines, such as illustrated in U.S. Pat. Nos. 5,495,049 and 5,587,263, the disclosures of which are totally incorporated herein by reference; an imaging member wherein the electron transport component is (4-n-butoxycarbonyl-9-fluorenylidene)malononitrile, 2-methylthioethyl 9-dicyanomethylenefluorene-4-carboxylate, 2-(3-thienyl) ethyl 9-dicyanomethylenefluorene-4-carboxylate, 2-phenylthioethyl 9-dicyanomethylenefluorene-4-carboxylate, 11,11,12,12-tetracyano anthraquinodimethane, 1 ,3-dimethyl-10-(dicyanomethylene)-anthrone or N,N'-(bis alkyl or aryl)-1,4,5,8-naphthalene tetracarboxylic diimide; an imaging member wherein the photogenerating component is Type V hydroxygallium phthalocyanine; an imaging member wherein the photogenerating component is Type V hydroxygallium phthalocyanine, the electron transport is preferably N,N'-(bis alkyl or aryl)-1,4,5,8-naphthalene tetracarboxylic diimide, and the charge transport is a hole transport of N,N'-diphenyl-N,N-bis(3-methyl phenyl)-1,1'-biphenyl-4,4'-diamine molecules; an imaging member wherein the Type V hydroxygallium phthalocyanine is prepared by hydrolyzing a gallium phthalocyanine precursor by dissolving the hydroxygallium phthalocyanine in a strong acid and then reprecipitating the resulting dissolved precursor in a basic aqueous media; removing any ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, at Bragg angles (2 theta+/−2.0°) 7.4, 9.8, 12.4, 16.2, 17.6, 18.4, 21.9, 23.9, 25.0, 28.1 degrees, and the highest peak at 7.4 degrees; an imaging member wherein the photogenerating component mixture layer further contains a metal free phthalocyanine; an imaging member wherein the photogenerating component mixture layer further contains a metal phthalocyanine; an imaging member wherein the photogenerating mixture layer contains a perylene or dimeric perylene; an imaging member wherein the photogenerating component is comprised of a mixture of hydroxygallium phthalocyanine, and a second photogenerating pigment; a photoconductive imaging member comprised of a layer comprised of a hydroxygallium photogenerator, a charge transport and an electron transport; a method of imaging wherein the imaging member is exposed to light of a wavelength of from about 500 to about 950 nanometers; an imaging apparatus containing a charging component, a development component, a transfer component, and a fixing component and wherein the apparatus contains a photoconductive imaging member comprised of supporting substrate, and thereover a layer comprised of a hydroxygallium photogenerator component, a charge transport component, and an electron transport component and as a top layer a charge transport layer; a member wherein the charge transport is comprised of hole transport molecules; a member wherein the electron transport is (4-n-butoxycarbonyl-9-fluorenylidene)malononitrile, 2-methylthioethyl 9-dicyanomethylene fluorene-4-carboxylate, 2-(3-thienyl) ethyl 9-dicyanomethylenefluorene-4-carboxylate, 2-phenylthioethyl 9-dicyanomethylenefluorene-4-carboxylate, 11,11,12,12-tetracyano anthraquinodimethane or 1,3-dimethyl-10-(dicyanomethylene)-anthrone, N,N'-(bis alkyl or aryl)-1,4,5,8-naphthalene tetracarboxylic diimide and the photogenerating hydroxygallium is Type V hydroxygallium phthalocyanine; an imaging member further containing in combination an adhesive layer and a hole blocking layer; an imaging member wherein the blocking layer is contained as a layer on a substrate or wherein the adhesive layer is coated on the blocking layer; and photoconductive imaging members comprised of an optional supporting substrate, a single layer comprised of a photogenerating layer of hydroxygallium phthalocyanine, and optionally further BZP perylene, which BZP is comprised of a mixture of bisbenzimidazo(2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f')diisoquinoline-10,21-dione, reference U.S. Pat. No. 4,587,189, the disclosure of which is totally incorporated herein by reference, charge transport molecules, electron transport components, and a binder polymer and a second layer thereover comprised of charge transport molecules, such as aryl amines, reference for example, U.S. Pat. No. 4,265,990. Preferably, the charge transport molecules for both the photogenerating mixture layer and for the top layer are aryl amines, molecules, and the electron transport is a fluorenylidene, such as (4-n-butoxycarbonyl-9-fluorenylidene)malononitrile, reference U.S. Pat. No. 4,474,865, the disclosure of which is totally incorporated herein by reference.

The negatively charged photoresponsive imaging member of the present invention in embodiments is comprised, in the following sequence, of a supporting substrate, a single layer thereover comprised of a photogenerator layer comprised of Type V hydroxygallium phthalocyanine, charge transport molecules of N,N'-diphenyl-N,N'-bis(3-methyl phenyl)-1,1'-biphenyl-4,4'-diamine, and electron transport components of N,N'-(bis alkyl or aryl)-1,4,5,8-naphthalene tetracarboxylic diimide all preferably dispersed in a suitable resin binder, such as a polycarbonate binder, and overcoated a charge transport layer thereover comprised of aryl amine molecules dispersed in a suitable resin binder.

The imaging member may be imaged by depositing a uniform electrostatic charge on the imaging member exposing the imaging member to activating radiation in image configuration to form an electrostatic latent image, and developing the latent image with electrostatically attractable marking particles to form a toner image in conformance to the latent image.

Any suitable substrate may be selected for the imaging member illustrated herein. The substrate may be opaque or substantially transparent, and may comprise any suitable material having the requisite mechanical properties. Thus, for example, the substrate may comprise a layer of insulating material including inorganic or organic polymeric materials, such as MYLAR® a commercially available polymer, MYLAR® coated titanium, a layer of an organic or inorganic material having a semiconductive surface layer, such as indium tin oxide, aluminum, titanium and the like, or exclusively be made up of a conductive material such as aluminum, chromium, nickel, brass and the like. The substrate may be flexible, seamless or rigid and may have a number of many different configurations, such as, for example, a plate, a drum, a scroll, an endless flexible belt, and the like. In one embodiment, the substrate is in the form of a seamless flexible belt. The back of the substrate, particularly when the substrate is a flexible organic polymeric material, may optionally be coated with a conventional anticurl layer.

The thickness of the substrate depends on many factors, including economical considerations, thus this layer may be of substantial thickness, for example over 3,000 microns, or of a minimum thickness. In embodiments, the thickness of this layer is from about 75 micrometers to about 275 micrometers.

If desired an optional adhesive undercoat layer may be formed on the substrate. Typical materials selected for the undercoat layer include, for example, polyesters, polyamides, poly(vinyl butyral), poly(vinyl alcohol), polyurethane and polyacrylonitrile, and the like. Typical polyesters include, for example, VITEL® PE100 and PE200 available from Goodyear Chemicals, and MOR-ESTER 49,000® available from Norton International. The undercoat layer may have any suitable thickness, for example, from about 0.001 micrometer to about 5 micrometers, from about 0.1 micrometer to about 3 micrometers, and the like. Optionally, the undercoat layer may contain suitable amounts of additives, for example from about 1 weight percent to about 10 weight percent, of conductive or nonconductive particles, such as zinc oxide, titanium dioxide, silicon nitride, carbon black, and the like, to enhance, for example, electrical and optical properties. The undercoat layer can be coated on to a supporting substrate from a suitable solvent. Typical solvents include, for example, tetrahydrofuran, dichloromethane, and the like, and mixtures thereof.

Examples of photogenerating components, especially pigments are metal free phthalocyanines, metal phthalocyanines, perylenes, dimeric perylenes, and more specifically, hydroxygallium dimers, hydroxygallium phthalocyanines, chlorogallium phthalocyanines, titanyl phthalocyanines, vanadyl phthalocyanines, chloroindium phthalocyanines, and benzimidazole perylenes, such as a mixture of, for example, 60/40, 50/50, 40/60, bisbenzimidazo(2,1-a-1',2'-b)anthra(2,1,9-def:6,5,10-d'e'f') diisoquinoline-6,11-dione and bisbenzimidazo(2,1-a:2',1 '-a) anthra(2,1,9-def:6,5,10-d'e'f')diisoquinoline-10,21-dione, and the like, inclusive of appropriate known photogenerating components.

Charge transport components that may be selected for both the photogenerating mixture and the charge transport layer thereover include, for example, arylamines, and more specifically, N,N'-diphenyl-N,N-bis(3-methyl phenyl)-1,1'-biphenyl-4,4'-diamine, 9-9-bis(2-cyanoethyl)-2,7-bis (phenyl-m-tolylamino)fluorene, tritolylamine, hydrazone, N,N'-bis(3,4 dimethylphenyl)-N"(1-biphenyl) amine, and triarylamines such as illustrated in U.S. Pat. Nos. 5,495,049 and 5,587,263, the disclosures of which are totally incorporated herein by reference; and the like.

Specific examples of electron transport molecules are (4-n-butoxycarbonyl-9-fluorenylidene)malononitrile, 2-methylthioethyl 9-dicyano methylenefluorene-4-carboxylate, 2-(3-thienyl)ethyl 9-dicyanomethylene fluorene-4-carboxylate, 2-phenylthioethyl 9-dicyanomethylenefluorene-4-carboxylate, 11,11,12,12-tetracyano anthraquinodimethane, 1,3-dimethyl-10-(dicyanomethylene)-anthrone, N,N'-(bis alkyl or aryl)-1,4,5,8-naphthalene
tetracarboxylic diimide, and the like. Examples of formulas for specific electron transporting components are (4-n-butoxycarbonyl-9-fluorenylidene) malononitrile of the following formulas

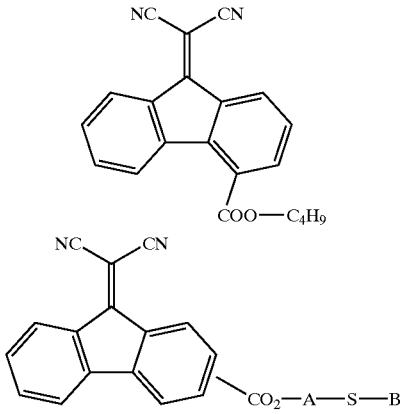

wherein S is sulfur, A is a spacer group selected from the group consisting of alkylene groups, arylene groups, and B is selected from the group consisting of alkyl groups, and aryl groups. Specific examples include 2-methylthioethyl 9-dicyanomethylenefluorene-4-carboxylate, 2-(3-thienyl) ethyl 9-dicyano methylenefluorene-4-carboxylate, a 2-phenylthioethyl 9-dicyano methylenefluorene-4-carboxylate, and the like. Further, specific examples of a suitable electron transporting molecule are N,N'-bis(alkyl or aryl)-1,4,5,8-naphthalenetetracarboxylic diimide represented by the following structural formula

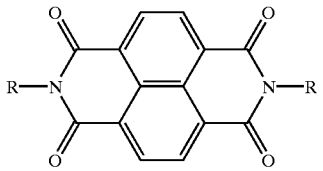

wherein R is chosen from the group consisting of hydrogen, alkyl, branched alkyl, cycloalkyl, substituted alkyl, aryl or substituted alkyl, all having between 1 and 30 atoms.

The photogenerating components, the electron transport components and the charge transport components can be dispersed in a suitable binder, such as polycarbonates, polyesters, polyvinylbutaryl, polysiloxanes polyarylates, polyphenylene oxides, polyphenylene sulfonamides, polyimides, polyetherimides, and polyurethanes. The photogenerating pigment can be present in various amounts, such as, for example, from about 0.05 weight percent to about 30 weight percent, and more specifically, from about 0.05 weight percent to about 5 weight percent. Charge transport components, such as hole transport molecules can be present in various effective amounts, such as in an amount of from about 10 weight percent to about 75 weight percent, and more specifically, in an amount of from about 30 weight percent to about 50 weight percent, the electron transport molecule can be present in various amounts, such as in an amount of from about 10 weight percent to about 75 weight percent, and more specifically, in an amount of from about 5 weight percent to about 30 weight percent, and the polymer binder can be present in an amount of from about 10 weight percent to about 75 weight percent, and more specifically, in an amount of from about 30 weight percent to about 50 weight percent. The thickness of a single photogenerating layer can be, for example, from about 3 microns to about 50 microns, and more specifically, from about 5 microns to about 20 microns.

The binder resin, present in various suitable amounts, for example from about 5 to about 70, and more specifically, from about 10 to about 50 weight percent, may be selected from a number of known polymers such as poly(vinyl butyral), poly(vinyl carbazole), polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and the like. In embodiments of the present invention, it is desirable to select as the single layer coating solvents, such as ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photoconductive imaging members can be prepared by a number of methods, such as the coating of the components from a dispersion, and more specifically, as illustrated herein. Thus, the photoresponsive imaging members of the present invention can in embodiments be prepared by a number of known methods, the process parameters being dependent, for example, on the member desired. The photogenerating, electron transport, and hole transport components of the imaging members can be coated as solutions or dispersions onto a selective substrate by the use of a spray coater, dip coater, extrusion coater, roller coater, wire-bar coater, slot coater, doctor blade coater, gravure coater, and the like, and dried, for example, at from about 40° C. to about 200° C. for a suitable period of time, such as from about 10 minutes to about 10 hours, under stationary conditions or in an air flow. The coating can be accomplished to provide a final coating thickness of from about 0.01 to about 30 microns after drying. The fabrication conditions for a given photoconductive layer can be tailored to achieve optimum performance and cost for the generation of the final members.

Imaging members of the present invention are useful in various electrostatographic imaging and printing systems, particularly those conventionally known as xerographic processes. Specifically, the imaging members of the present invention are useful in xerographic imaging processes including printing and color processes wherein the photogenerating component, such as Type V hydroxygallium phthalocyanine can absorb light of a wavelength of from about 300 to about 950 nanometers, and preferably from about 700 to about 850 nanometers. Moreover, the imaging members of the present invention can be selected for electronic printing processes with gallium arsenide diode lasers, light emitting diode (LED) arrays which typically function at wavelengths of from 660 to about 830 nanometers.

Also, disclosed are methods of imaging and printing with the photoresponsive or photoconductive members illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing, for example by heat, the image thereto. In those environments wherein the member is to be used in a printing mode, the imaging method is similar with the exception that the exposure step can be accomplished with a laser device or image bar.

All XRPDs were determined as indicated herein that is by X-ray powder diffraction traces (XRPDs) were generated on a Philips X-Ray Powder Diffractometer Model 1710 using X-radiation of CuK-alpha wavelength (0.1542 nanometer). The diffractometer was equipped with a graphite monochrometer and pulse-height discrimination system. Two-theta is the Bragg angle commonly referred to in x-ray crystallographic measurements. I (counts) represents the intensity of the diffraction as a function of Bragg angle as measured with a proportional counter.

The electron transporting materials provide, for example, the desired rheology and freedom from agglomeration during the preparation and application of the coating dispersion. Moreover, these electron transporting materials ensure substantial discharge of the photoreceptor during imagewise exposure to form the electrostatic latent image.

The following Examples are provided.

EXAMPLE I

A pigment dispersion was prepared by roll milling 2.15 grams of Type V hydroxygallium phthalocyanine pigment particles and 2.15 grams of poly(4,4'-diphenyl-1,1'-cyclohexane carbonate) (PCZ400, available from Mitsubishi Gas Chemical Company, Inc.) binder in 26.5 grams of tetrahydrofuran (THF) and 6.6 grams of monochlorobenzene with 280 grams of 3 millimeter diameter steel balls for about 25 to about 30 hours.

Separately, 1.86 grams of poly(4,4'-diphenyl-1,1'-cyclohexane carbonate) were weighed together with 1.22 grams of N,N'-diphenyl-N,N'-bis(methylphenyl)-1,1-biphenyl-4,4'-diamine, 0.81 gram of N,N'-bis(1,2-dimethylpropyl)-1,4,5,8-naphthalenetetracarboxylic diimide, 8.76 grams of THF and 2.19 grams of monochlorobenzene. This mixture was rolled in a glass bottle until the solids were dissolved, then 1.41 grams of the above pigment dispersion were added to form a dispersion containing Type V hydroxygallium phthalocyanine, poly(4,4'-diphenyl-1,1'-cyclohexane carbonate), N,N'-diphenyl-N,N'-bis(methylphenyl)-1,1-biphenyl-4,4'-diamine, and N,N'-bis(1,2-dimethylpropyl)-1,4,5,8-naphthalene tetracarboxylic diimide in a solids weight ratio of (2:48:30:20) with a total solid contents of 27 percent; and further rolled mix (without milling beads). Various dispersions were prepared at total solids contents of from 25 percent to 28.5 percent. The dispersions were applied with a 3 mil film coating applicator to an aluminized MYLAR® (polyethylene terephthalate) and dried at 115° C. for 60 minutes to result in a thickness for the first layer of about 10 microns.

Separately, a hole transporting layer solution was prepared by weighing 1.44 grams of poly(4,4'-diphenyl-1,1'-cyclohexane carbonate) together with 0.96 gram of N,N'-diphenyl-N,N'-bis(methylphenyl)-1,1-biphenyl-4,4'-diamine and 12.5 grams of monochlorobenzene chlorobenzene. This mixture was mixed in a glass bottle until the solids were dissolved. The resulting solution was coated onto the above prepared Type V hydroxy gallium phthalocyanine, poly(4,4'-diphenyl-1,1'-cyclohexane carbonate), N,N'-diphenyl-N,N'-bis(methylphenyl)-1,1-biphenyl-4,4'-diamine, and N,N'-bis(1,2-dimethylpropyl)-1,4,5,8-naphthalene tetracarboxylic diimide layer using a 6 mil film applicator. The hole transporting layer thus obtained was dried at 115° C. for 60 minutes to provide a final total film thickness of about 25 microns. The thickness of the resulting dried layers was determined by capacitive measurements and a thickness gauge.

EXAMPLE II

The xerographic electrical properties of the above prepared photoconductive imaging member and other similar members can be determined by known means, including electrostatically charging the surfaces thereof with a corona discharge source until the surface potentials, as measured by a capacitively coupled probe attached to an electrometer, attained an initial value $V_0$ of about −800 volts. After resting for 0.5 second in the dark, the charged members attained a surface potential of $V_{ddp}$, dark development potential. Each member was then exposed to light from a filtered Xenon lamp thereby inducing a photodischarge which resulted in a reduction of surface potential to a $V_{bg}$ value, background potential. The percent of photodischarge was calculated as $100\times(V_{ddp}-V_{bg})/V_{ddp}$. The desired wavelength and energy of the exposed light was determined by the type of filters placed in front of the lamp. The monochromatic light photosensitivity was determined using a narrow band-pass filter. The photosensitivity of the imaging member is usually provided in terms of the amount of exposure energy in ergs/cm$^2$, designated as $E_{1/2}$, required to achieve 50 percent photodischarge from $V_{ddp}$ to half of its initial value. The higher the photosensitivity, the smaller is the $E_{1/2}$ value. The $E_{7/8}$ value corresponds to the exposure energy required to achieve ⅞ photodischarge from $V_{ddp}$. The device was finally exposed to an erase lamp of appropriate light intensity and any residual potential ($V_{residual}$) was measured. The imaging members were tested with a monochromatic light exposure at a wavelength of 780+/−10 nanometers and an erase light with the wavelength of 600 to 800 nanometers and intensity of 150 ergs cm$^2$.

Photoinduced discharge characteristics (PIDC) curves in a negative charging mode of the 25 micrometer thick device of Example I exhibited an $E_{1/2}$ of 1.8 ergs/cm$^2$, an $E_{7/8}$ of 8.2 ergs/cm$^2$ and a residual potential of less than about 20 volts, such as 18 volts.

EXAMPLE III

The processes of Example I were repeated except that (4-n-butoxycarbonyl-9-fluorenylidene)malononitrile, an electron transport molecule, was substituted for N,N'-bis(1, 2-dimethylpropyl)-1,4,5,8-naphthalene tetracarboxylic diimide. This coating was applied to an aluminized MYLAR® substrate. The resulting device was similar in characteristics to the device of Examples I and II.

EXAMPLE IV

A pigment dispersion was prepared by roll milling 2.15 grams of metal free phthalocyanine pigment particles, such as x-metal free phthalocyanines and 2.15 grams of poly(4,4'-diphenyl-1,1'-cyclohexane carbonate) (PCZ400, available from Mitsubishi Gas Chemical Company, Inc.) binder in 26.5 grams of tetrahydrofuran (THF) and 6.6 grams of monochlorobenzene with 280 grams of 3 millimeter diameter steel balls for about 2 to about 5 hours.

Separately, 1.86 grams of poly(4,4'-diphenyl-1,1'-cyclohexane carbonate) were weighed along with 1.22 grams of N,N'-diphenyl-N,N'-bis(methylphenyl)-1,1-biphenyl-4,4'-diamine, 0.81 gram of N,N'-bis(1,2-dimethylpropyl)-1,4,5,8-naphthalene tetracarboxylic diimide, 8.76 grams of THF and 2.19 grams of monochlorobenzene. This mixture was rolled or mixed in a glass bottle until the solids were dissolved, then 1.41 grams of the above prepared pigment dispersion were added to form a dispersion containing the metal free phthalocyanine, poly(4,4'-diphenyl-1,1'-cyclohexane carbonate), N,N'-diphenyl-N,N'-bis(methylphenyl)-1,1-biphenyl-4,4'-diamine, and N,N'-bis(1,2-dimethylpropyl)-1,4,5,8-naphthalene tetracarboxylic diimide in a solids weight ratio of (2:48:30:20) and a total solid contents of 27 percent; and rolled to mix (without milling beads). Various dispersions were prepared at total solids contents ranging from 25 percent to 28.5 percent. More than 5 dispersions prepared at these ratios were applied with a 3 mil film coating applicator to an aluminized MYLAR® (polyethylene terephthalate) and dried at 115° C. for 60 minutes to result in a thickness for the first layer of about 10 microns.

Separately, a hole transporting layer solution was prepared by dissolving 1.44 grams of poly(4,4'-diphenyl-1,1'-cyclohexane carbonate) weighed along with 0.96 gram of N,N'-diphenyl-N,N'-bis(methylphenyl)-1,1-biphenyl-4,4'-diamine and 12.5 grams of monochlorobenzene chlorobenzene. This mixture was rolled in a glass bottle until the solids were dissolved. The solution was coated onto the previously described metal free phthalocyanine, poly(4,4'-diphenyl-1,1'-cyclohexane carbonate), N,N'-diphenyl-N,N'-bis(methylphenyl)-1,1-biphenyl4,4'-diamine, and N,N'-bis(1,2-dimethylpropyl)-1,4,5,8-naphthalene tetracarboxylic diimide layer using a 6 mil film applicator. The hole transporting layer thus obtained was dried at 115° C. for 60 minutes to provide a final total film thickness of about 25 microns. The thickness of the resulting dried layers was determined by capacitive measurements and a thickness gauge.

The resulting bilayer member will possess, it is believed, excellent electrical stability for extended cycling.

Other embodiments and modifications of the present invention may occur to those skilled in the art subsequent to a review of the information presented herein; these embodiments and modifications, equivalents thereof, substantial equivalents thereof, or similar equivalents thereof are also included within the scope of this invention.

What is claimed is:

1. A photoconductive member comprised of a supporting substrate, and thereover a first layer comprised of a mixture of a photogenerator component, a hole transport component, and an electron transport component; and thereover a second layer comprised of a charge transport component.

2. An imaging member in accordance with claim 1 wherein said first layer is of a thickness of from about 3 to about 50 microns.

3. An imaging member in accordance with claim 1 wherein the amounts for each of said components in said first layer are from about 0.05 weight percent to about 30 weight percent for the photogenerating component, from about 10 weight percent to about 75 weight percent for the charge transport component, and from about 10 weight percent to about 75 weight percent for the electron transport component, and wherein the total of said components is about 100 percent; and wherein said layer is optionally dispersed in from about 10 weight percent to about 75 weight percent of a polymer binder, and wherein said first layer is of an optional thickness of from about 5 to about 20 microns.

4. An imaging member in accordance with claim 1 wherein the amounts for each of said components in the first layer mixture are from about 0.5 weight percent to about 5 weight percent for the photogenerating component; from about 30 weight percent to about 50 weight percent for the charge transport component; and from about 5 weight percent to about 30 weight percent for the electron transport component; and which components are contained in from about 30 weight percent to about 50 weight percent of a polymer binder.

5. An imaging member in accordance with claim 1 wherein the thickness of said first layer is from about 5 to about 20 microns.

6. An imaging member in accordance with claim 1 wherein said first layer components are contained in a polymer binder, and wherein said hole transport in said first layer is comprised of hole transport molecules and electron transport molecules, and wherein said charge transport in said second layer is comprised of hole transport molecules.

7. An imaging member in accordance with claim 6 wherein said binder is present in an amount of from about 40 to about 90 percent by weight, and wherein the total of components of said photogenerating component, said charge transport component, said binder, and said electron transport component is about 100 percent.

8. An imaging member in accordance with claim 1 wherein said photogenerating component is a pigment of a hydroxygallium phthalocyanine that absorbs light of a wavelength of from about 350 to about 950 nanometers.

9. An imaging member in accordance with claim 1 wherein the supporting substrate is comprised of a conductive substrate comprised of a metal.

10. An imaging member in accordance with claim 9 wherein the conductive substrate is aluminum, aluminized polyethylene terephthalate or titanized polyethylene terephthalate.

11. An imaging member in accordance with claim 6 wherein said binder is selected from the group consisting of polyesters, polyvinyl butyrals, polycarbonates, polystyrene-b-polyvinyl pyridine, polyarylates, polyphenylene oxides, polyphenylene sulfonamides, polyimides, polyetherimides, polyesters, polyvinyl butyrals, polystyrenes and copolymers thereof and polyvinyl formals.

12. An imaging member in accordance with claim 1 wherein said charge transport in said second layer comprises aryl amine molecules.

13. An imaging member in accordance with claim 1 wherein said first layer hole transporting component or components, and/or said second layer is comprised of molecules of the formula

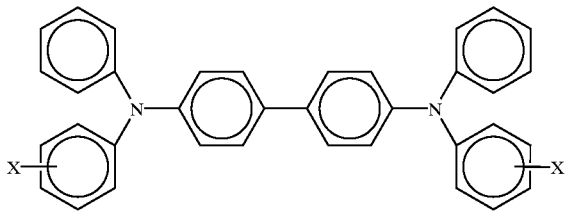

wherein X is selected from the group consisting of an alkyl, a halogen, an aryl or mixtures thereof.

14. An imaging member in accordance with claim 13 wherein alkyl contains from about 1 to about 30 carbon atoms and wherein the charge transport is an aryl amine encompassed by said formula and which amine is optionally dispersed in a highly insulating and transparent resinous binder.

15. An imaging member in accordance with claim 13 wherein alkyl contains from 1 to about 5 carbon atoms.

16. An imaging member in accordance with claim 13 wherein alkyl is methyl, and wherein halogen is chloride.

17. An imaging member in accordance with claim 13 wherein said charge component is comprised of N,N'-diphenyl-N,N-bis(3-methyl phenyl)-1,1'-biphenyl4,4'-diamine.

18. An imaging member in accordance with claim 1 wherein said electron transport component is (4-n-butoxycarbonyl-9-fluorenylidene) malononitrile, 2-methylthioethyl 9-dicyanomethylenefluorene-4-carboxylate, 2-(3-thienyl)ethyl 9-dicyanomethylenefluorene-4-carboxylate, 2-phenylthioethyl 9-dicyanomethylenefluorene-4-carboxylate, 11,11,12,12-tetracyano anthraquinodimethane N,N'-(bis alkyl or aryl)-1,4,5,8-naphthalene diimide or 1,3-dimethyl-10-(dicyanomethylene)-anthrone.

19. An imaging member in accordance with claim 1 wherein said electron transport component is (4-n-butoxycarbonyl-9-fluorenylidene)malononitrile.

20. An imaging member in accordance with claim 13 wherein said electron transport component is (4-n-butoxycarbonyl-9-fluorenylidene)malononitrile, 2-methylthioethyl 9-dicyanomethylenefluorene-4-carboxylate, 2-(3-thienyl)ethyl 9-dicyanomethylenefluorene-4-carboxylate, 2-phenylthioethyl 9-dicyanomethylenefluorene-4-carboxylate, 11,11,12,12-tetracyano anthraquinodimethane or 1,3-dimethyl-10-(dicyanomethylene)-anthrone.

21. An imaging member in accordance with claim 1 wherein the photogenerating component is titanyl phthalocyanine, a metal phthalocyanine other than titanyl phthalocyanine, a metal free phthalocyanine, a perylene, a dimeric perylene, trigonal selenium, or mixtures thereof.

22. An imaging member in accordance with claim 1 wherein for said first layer the photogenerating component is Type V hydroxygallium phthalocyanine, the electron transport is (4-n-butoxy carbonyl-9-fluorenylidene) malononitrile, and the hole transport is N,N'-diphenyl-N,N-bis(3-methyl phenyl)-1,1'-biphenyl4,4'-diamine.

23. An imaging member in accordance with claim 1 wherein for said first layer the photogenerating component is Type V hydroxygallium phthalocyanine, the electron transport is N,N'-(bis alkyl or aryl)-1,4,5,8-naphthalene diimide, and the hole transport is comprised of N,N'-diphenyl-N,N-bis(3-methyl phenyl)-1,1'-biphenyl-4,4'-diamine.

24. An imaging member in accordance with claim 23 wherein the Type V hydroxygallium phthalocyanine has major peaks, as measured with an X-ray diffractometer, at Bragg angles (2 theta+/−0.2°) of 7.4, 9.8, 12.4, 16.2, 17.6, 18.4, 21.9, 23.9, 25.0, 28.1 degrees, and the highest peak at 7.4 degrees.

25. A member comprised of a mixture containing a photogenerating component, a charge transport component, and an electron transport component, and in contact with said first layer a second layer comprised of a charge transport component optionally dispersed in a resin binder.

26. A member in accordance with claim 25 wherein said electron transport is (4-n-butoxycarbonyl-9-fluorenylidene) malononitrile, 2-methylthioethyl 9-dicyanomethylenefluorene-4-carboxylate, 2-(3-thienyl)ethyl 9-dicyanomethylenefluorene-4-carboxylate, 2-phenylthioethyl 9-dicyanomethylenefluorene-4-carboxylate, 11,11,12,12-tetracyano anthraquinodimethane or 1,3-dimethyl-10-(dicyanomethylene)-anthrone, said charge transports are hole transports, said photogenerating component is an organic or inorganic photogenerating pigment, and said binder is present.

27. An imaging member in accordance with claim 1 further containing an adhesive layer and a hole blocking layer.

28. An imaging member in accordance with claim 27 wherein said blocking layer is contained as a coating on said substrate, and wherein said adhesive layer is coated on said blocking layer.

29. An imaging member in accordance with claim 1 wherein said member comprises in the following sequence said supporting layer, a first electrophotographic photoconductive insulating layer, the layer comprising particles comprising a photogenerating pigment dispersed in a matrix comprising an arylamine hole transport and an electron transport.

30. An imaging member in accordance with claim 1 wherein said electron transport is N,N'-bis(alkyl or aryl)-1,4,5,8-naphthalene tetracarboxylic diimide represented by the formula

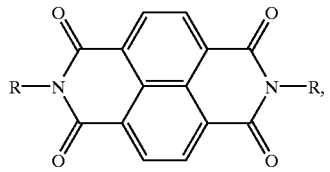

1,1'-dioxo-2-(4-methylphenyl)-6-phenyl-4-(dicyanomethylidene) thiopyran represented by the following formula

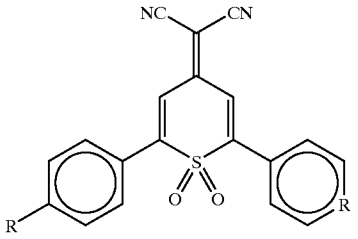

wherein each R is independently selected from the group consisting of hydrogen, alkyl optionally with 1 to 4 carbon atoms, alkoxy optionally with 1 to 4 carbon atoms and halogen, and a quinone selected from the group consisting of carboxybenzylnaphthaquinone represented by the following formula

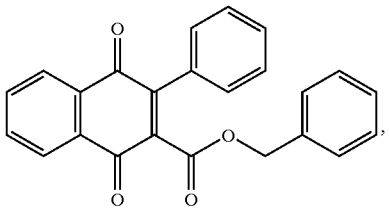

tetra (t-butyl) diphenoquinone represented by the following formula

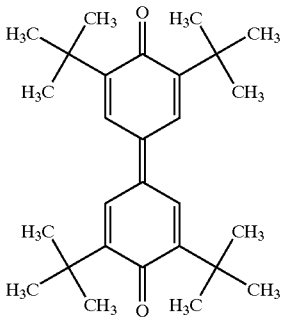

and mixtures thereof, and a film forming binder and a second layer over said first layer, and wherein said second layer is comprised of hole transport components.

31. An imaging member according to claim 30 wherein the hole transport is comprised of an arylamine of N,N'-diphenyl-N,N'-bis(3-methylphenyl)-[1,1'-biphenyl]-4,4'-diamine, the film forming binder is a polycarbonate, said first electrophotographic photoconductive insulating layer has a thickness of about 3 micrometers to about 50 micrometers after drying; or wherein the photogenerating photoconductive insulating layer has a thickness of about 5 micrometers to about 20 micrometers after drying, wherein the member is free of any charge blocking layer between the supporting layer and the photogenerating layer, wherein the member is free of any charge generating layer between the supporting layer and the photogenerating layer, or wherein the member is free of any antiplywood layer between the supporting layer and the photogenerating layer.

32. A method of imaging which comprises generating an electrostatic latent image on the imaging member of claim 1, developing the latent image, and transferring the developed image to a suitable substrate.

33. A photoconductive member consisting essentially of a supporting substrate, and thereover a first layer comprised of a mixture of a photogenerator component, a hole transport component, and an electron transport component; and thereover a second layer comprised of a charge transport component; and wherein said electron transport component is (4-n-butoxycarbonyl-9-fluorenylidene) malononitrile, 2-methylthioethyl 9-dicyanomethylenefluorene-4-carboxylate, 2-(3thienyl)ethyl 9-dicyanomethylenefluorene-4-carboxylate, 2-phenylthioethyl 9-dicyanomethylenefluorene-4-carboxylate, 11,11,12,12-tetracyano anthraquinodimethane N,N'-(bis alkyl or aryl)-1,4,5,8-naphthalene diimide or 1,3-dimethyl-10-(dicyanomethylene)-anthrone.

* * * * *